US010651563B2

(12) United States Patent
Mori et al.

(10) Patent No.: US 10,651,563 B2
(45) Date of Patent: May 12, 2020

(54) CORNER REFLECTOR AND METHOD FOR FABRICATING SAME

(71) Applicants: IHI AEROSPACE CO., LTD., Tokyo (JP); SEIREN CO., LTD., Fukui (JP)

(72) Inventors: Mamoru Mori, Tokyo (JP); Hisanao Kataoka, Fukui (JP); Sachiyo Sakagawa, Fukui (JP); Susumu Takagi, Fukui (JP)

(73) Assignees: IHI AEROSPACE CO., LTD, Tokyo (JP); SEIREN CO., LTD., Fukui (JP)

( * ) Notice: Subject to any disclaimer, the term of this patent is extended or adjusted under 35 U.S.C. 154(b) by 317 days.

(21) Appl. No.: 15/549,857

(22) PCT Filed: Feb. 17, 2016

(86) PCT No.: PCT/JP2016/054608
§ 371 (c)(1),
(2) Date: Aug. 9, 2017

(87) PCT Pub. No.: WO2016/136559
PCT Pub. Date: Sep. 1, 2016

(65) Prior Publication Data

US 2018/0019521 A1 Jan. 18, 2018

(30) Foreign Application Priority Data

Feb. 23, 2015 (JP) ..... 2015/032549

(51) Int. Cl.
*H01Q 15/20* (2006.01)
*F41H 11/02* (2006.01)
*F41J 2/00* (2006.01)

(52) U.S. Cl.
CPC ..... *H01Q 15/20* (2013.01); *F41H 11/02* (2013.01); *F41J 2/00* (2013.01)

(58) Field of Classification Search
CPC ..... H01Q 15/20; H01Q 15/161; H01Q 15/16; H01Q 15/18; H01Q 19/106; H01Q 1/082; G01S 7/38; F41H 11/02; F41J 2/00
(Continued)

(56) References Cited

U.S. PATENT DOCUMENTS 6,300,893 B1 10/2001 Schaff et al.
2003/0016186 A1 1/2003 Watanabe et al.
2014/0125507 A1 5/2014 Yahagi et al.

FOREIGN PATENT DOCUMENTS

JP 53-47299 A 4/1978
JP 2002-200682 A 7/2002
(Continued)

OTHER PUBLICATIONS

Air-Inflated Fabric Structures, Paul V. Cavallaro, NUWC-NPT, Nov. 5, 2006 (Year: 2006).*
(Continued)

*Primary Examiner* — Vladimir Magloire
*Assistant Examiner* — Michael W Justice
(74) *Attorney, Agent, or Firm* — Merchant & Gould P.C.

(57) ABSTRACT

A corner reflector includes annular balloons, which, when gas is supplied to the inside, annularly expand, and radio wave reflective films each developed to a plane by the expansion of the annular balloons. The three annular balloons are provided so as to be orthogonal to each other in the expansion. A constraint fabric wound around each annular balloon is provided. The constraint fabric includes an inner peripheral side fabric portion located on the side of a virtual central axis of the annular balloon and extending in the annular direction around the virtual central axis, and an outer peripheral side fabric portion located on the side opposite to the virtual central axis and extending in the annular direction. The elongation degree of the outer peripheral side
(Continued)

fabric portion in the annular direction is higher than the elongation degree of the inner peripheral side fabric portion in the annular direction.

6 Claims, 7 Drawing Sheets

(58) Field of Classification Search
USPC ..... 342/8
See application file for complete search history.

(56) References Cited

FOREIGN PATENT DOCUMENTS

| | | | | |
|---|---|---|---|---|
| JP | 2008-279933 | A | 11/2008 | |
| JP | 2014-132222 | A | 1/2013 | |
| JP | 2013-213726 | A | 10/2013 | |
| WO | 2007/065137 | A2 | 6/2007 | |
| WO | 2013-008513 | A1 | 1/2013 | |
| WO | WO-2013008513 | A1 * | 1/2013 | ..... H01Q 15/20 |

OTHER PUBLICATIONS

Ripstop, https://en.wikipedia.org/wiki/Ripstop, Aug. 18, 2014 (Year: 2014).*

Cavallaro, Paul V., et al. "Air-Inflated Fabric Structures," NUWC-NPT Reprint Report 11,774, Nov. 5, 2006.

Extended European Search Report issued in corresponding application No. 16755306.4, completed Aug. 22, 2018 and dated Aug. 30, 2018.

English translation of the Written Opinion of the International Searching Authority issued in corresponding application PCT/JP2016/054608, dated May 17, 2016.

International Search Report issued in corresponding application PCT/JP2016/054606; completed May 2, 2016 and dated May 17, 2016.

Written Opinion issued in corresponding application PCT/JP2016/054608 dated May 17, 2016.

* cited by examiner

[FIG. 1A]
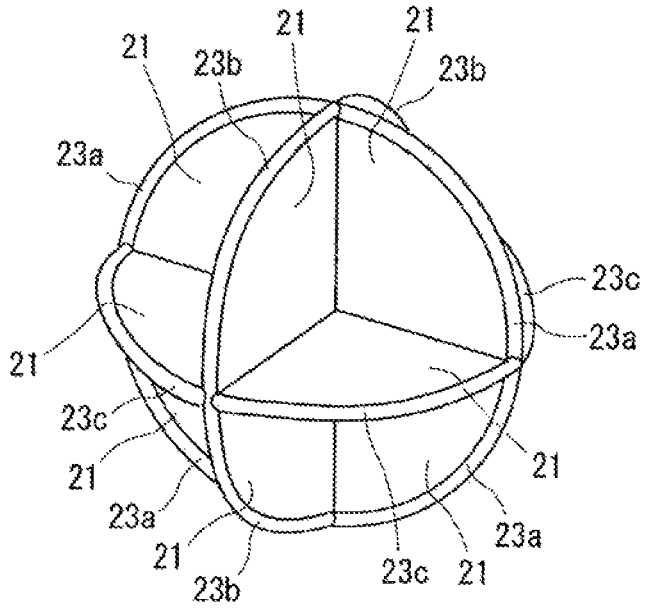
[FIG. 1B]
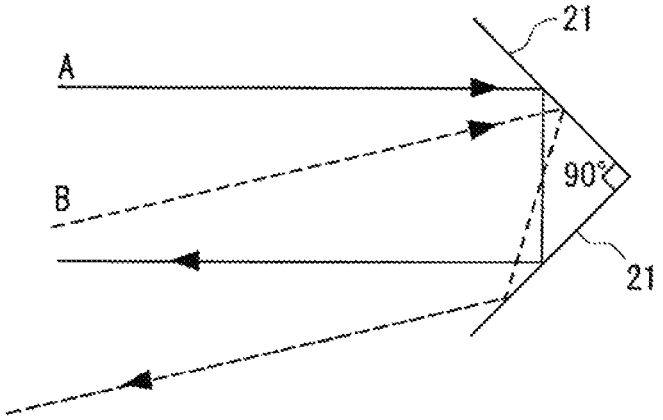

[FIG. 2]
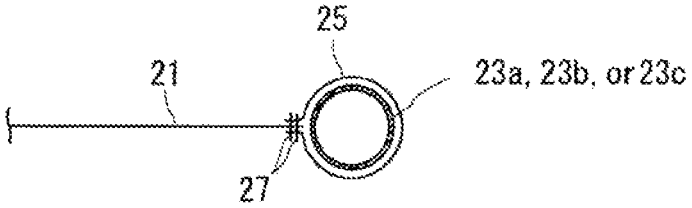

[FIG. 3A]
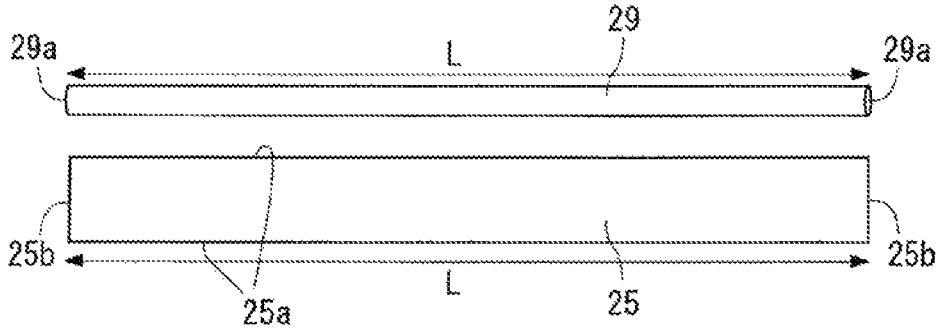
[FIG. 3B]
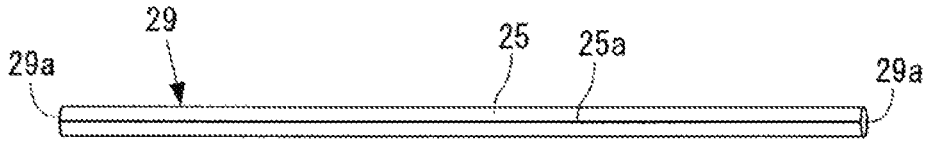
[FIG. 3C]
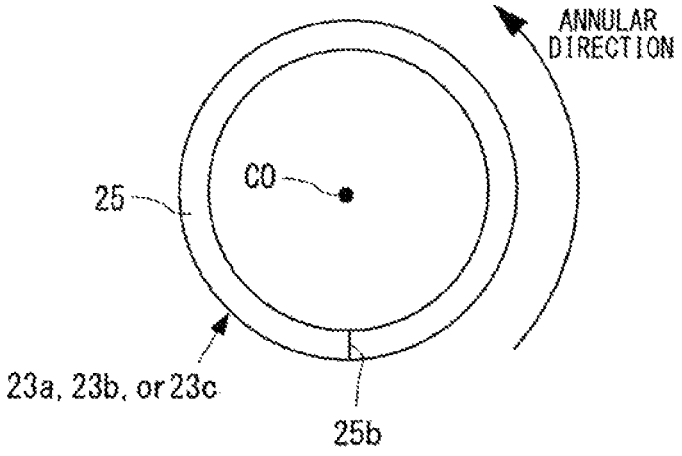

[FIG. 4A]
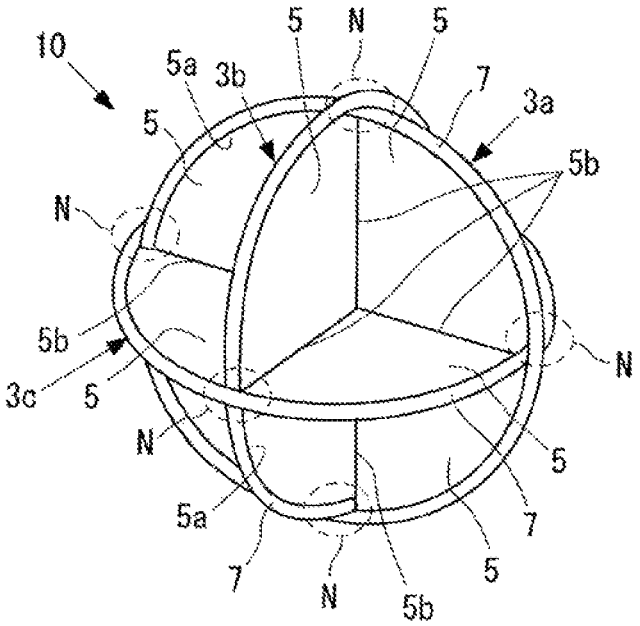
[FIG. 4B]
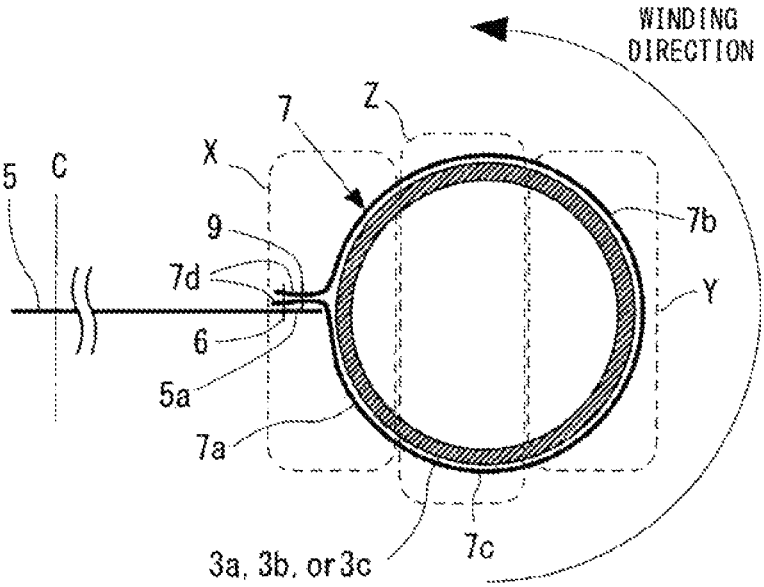

[FIG. 5A]
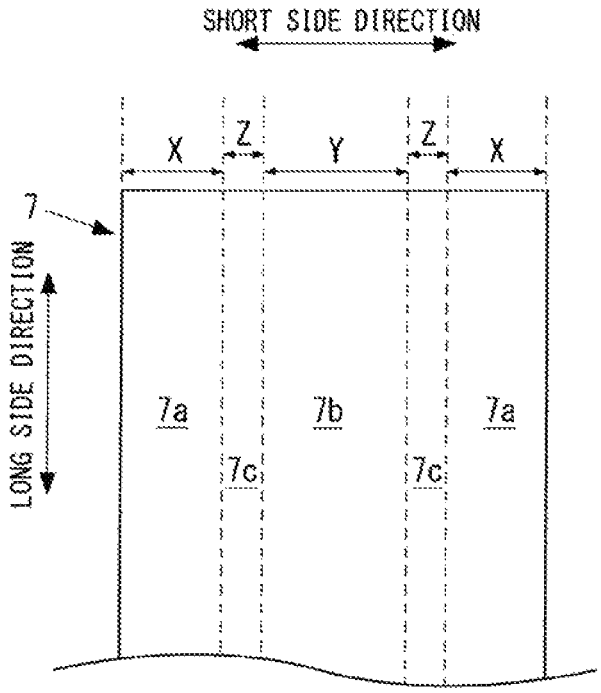
[FIG. 5B]
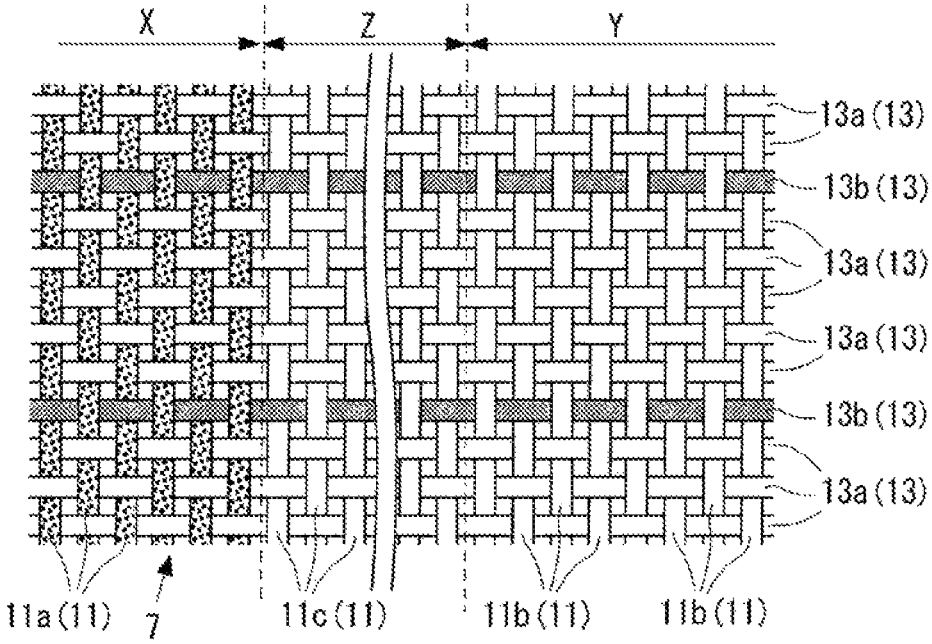

[FIG. 6]
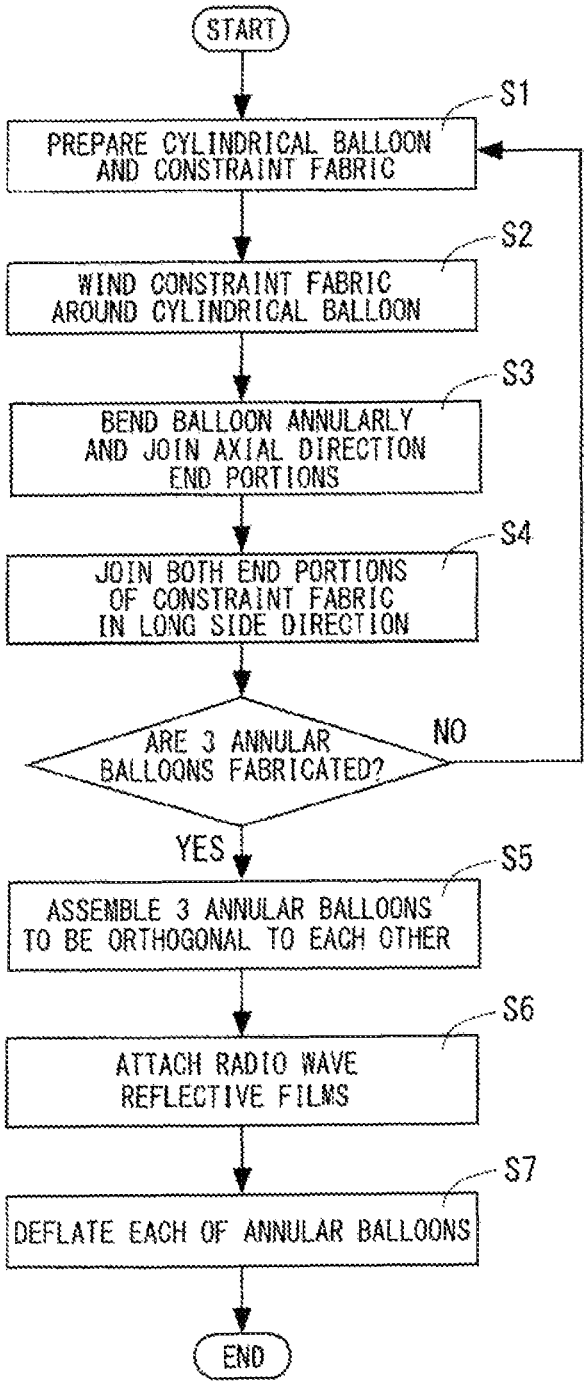

[FIG. 7A]
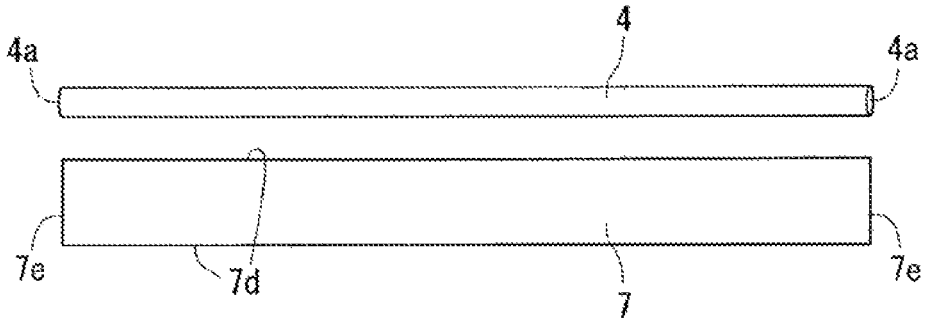
[FIG. 7B]
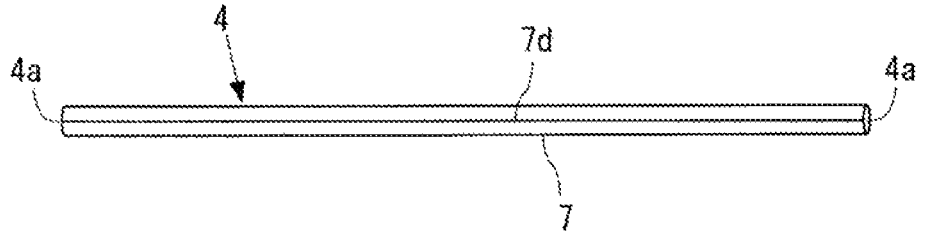
[FIG. 7C]
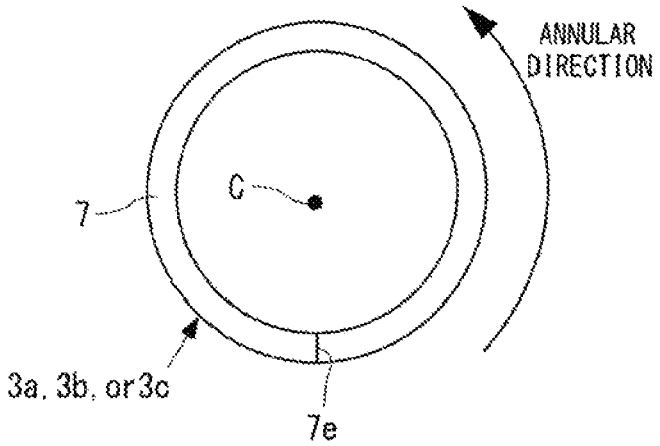

CORNER REFLECTOR AND METHOD FOR FABRICATING SAME

This is a National Phase Application in the United States of International Patent Application No. PCT/JP2016/054608 filed on Feb. 17, 2016, which claims priority on Japanese Patent Application No. 2015/032549, filed Feb. 23, 2015. The entire disclosures of the above patent applications are hereby incorporated by reference.

TECHNICAL FIELD

The present invention relates to a corner reflector which functions as a decoy by reflecting radio waves from a tracking radar apparatus, a missile radar seeker, and the like and a method for fabricating the same.

BACKGROUND ART

The corner reflector is described in Patent Document 1, for example. The corner reflector of Patent Document 1 has the configuration of FIG. 1A. The corner reflector has radio wave reflective films 21 which are orthogonal to each other as illustrated in FIG. 1A. Thus, even when radio waves enter the corner reflector from any angle, the corner reflector can reflect the radio waves in the entered direction.

For example, as illustrated in FIG. 1B, both a radio wave A and a radio wave B can be reflected in the entered directions by the radio wave reflective films 21 which are orthogonal to each other.

The corner reflector is released from a flying body, a vessel, the ground, and the like, and then developed to the shape of FIG. 1A in the air or on the water surface. For that end, the corner reflector of Patent Document 1 includes three annular balloons 23*a*, 23*b*, and 23*c* disposed on three virtual planes which are orthogonal to each other. The annular balloons 23*a*, 23*b*, and 23*c* expand when gas is supplied to the inside thereof, to exhibit annular shapes. Radio wave reflective films 21 are attached to the three annular balloons 23*a*, 23*b*, and 23*c* such that the radio wave reflective films 21 are developed by the expansion as illustrated in FIG. 1A.

With the configuration described above, when radio waves enter the corner reflector developed in the air from a tracking radar apparatus or a missile radar seeker, for example, the corner reflector can reflect the radio waves in the entered directions as illustrated in FIG. 1B. Thus, the corner reflector can be used as a decoy of radar.

CITATION LIST

Patent Literature

PTL 1: International Publication WO 2013/008513

SUMMARY OF INVENTION

Technical Problem

FIG. 2 is a cross-sectional view of the annular balloon 23*a*, 23*b*, or 23*c* along the plane orthogonal to the annular direction of the annular balloon 23*a*, 23*b*, or 23*c*. As illustrated in FIG. 2, a constraint fabric 25 for restricting the expansion amount thereof when the annular balloons 23*a*, 23*b*, and 23*c* expand is provided in Patent Document 1. The constraint fabric 25 is formed so as to surround the annular balloons 23*a*, 23*b*, and 23*c*. The constraint fabric 25 is sewn to the radio wave reflective film 21 by a thread 27.

The annular balloons 23*a*, 23*b*, and 23*c* can be fabricated according to the following procedure.

As illustrated in FIG. 3A, a cylindrical balloon 29 which expands to a moderate volume and the constraint fabric 25 are prepared. An axial direction length L of the cylindrical balloon 29 is the same as the long side direction length L of the constraint fabric 25 having a rectangular shape.

Thereafter, as illustrated in FIG. 3B, the constraint fabric 25 is wound around the cylindrical balloon 29. In this state, short side direction end portions 25*a* of the constraint fabric 25 are joined to each other by sewing, for example.

Next, the cylindrical balloon 29 is bent into an annular shape, and then annular direction end portions 29*a* are joined to each other (with an adhesive, for example). Thus, the cylindrical balloon 29 is transformed into the annular balloon 23*a*, 23*b*, or 23*c* annularly extending around a virtual central axis C0 as illustrated in FIG. 3C.

Next, long side direction end portions 25*b* of the constraint fabric 25 are joined to each other by sewing, for example. Thus, the annular balloon 23*a*, 23*b*, or 23*c* around which the constraint fabric 25 is wound is fabricated.

The annular balloons 23*a*, 23*b*, and 23*c* thus fabricated are assembled to each other so as to be orthogonal to each other, and then the radio wave reflective films 21 are attached to the annular balloons 23*a*, 23*b*, and 23*c* to fabricate a corner reflector. Thereafter, gas is removed from the inside of the annular balloons 23*a*, 23*b*, and 23*c* to keep the annular balloons deflated until the use of the corner reflector.

In the state where the cylindrical balloon 29 is annularly bent so that the long side direction end portions 25*b* of the constraint fabric 25 are joined to each other, the annular direction length of an outer peripheral side portion (portion on the side opposite to the virtual central axis C0 side described above) of the annular balloon is longer than the annular direction length of an inner peripheral side portion (portion on the virtual central axis C0 side described above) of the annular balloon.

Meanwhile, an inner peripheral side fabric portion and an outer peripheral side fabric portion of the constraint fabric 25 support the same surface pressure from the annular balloon, so that the inner peripheral side fabric portion and the outer peripheral side fabric portion try to elongate by the same amount in the annular direction. However, the annular direction length of the inner peripheral side fabric portion of the constraint fabric 25 is smaller than the annular direction length of the outer peripheral side fabric portion. Therefore, the elongation in the annular direction of the inner peripheral side fabric portion is restricted, and thus the inner peripheral side fabric portion cannot freely extend in the annular direction.

For such a reason, the elongated amount in the annular direction varies in the inner peripheral side portion of the constraint fabric 25, so that the shape of the constraint fabric 25 is not an exact annular (circular) shape, which results in the fact that the constraint fabric 25 is deformed in a direction different from the annular direction, at a part in the annular direction.

Under the influence, the annular shape accuracy of the annular balloons also decreases.

Therefore, in the constraint fabric 25, tuck processing (pinching and sewing a part of the constraint fabric 25 to make a tuck) for the inner peripheral side portion can be performed at equal intervals in the annular direction. Thus, the shape accuracy reduction of the annular balloon can be reduced.

However, the tuck processing requires time and effort and is complicated, and therefore the cost increases for making tucks so as to obtain a balloon of an annular ring shape with high accuracy.

In view of it, it is an object of the present invention to provide a corner reflector including an annular balloon of which expansion amount is restricted by a constraint fabric, with the shape accuracy of the annular balloon being high even when tuck processing or another processing is not performed on the constraint fabric, and to provide a method for fabricating the same.

Solution to Problem

In order to achieve the above-described object, according to the present invention, there is provided a corner reflector reflecting a radio wave, the corner reflector comprising:

three annular balloons each of which has flexibility and airtightness, and, when gas is supplied to an inside thereof, expands in an annular shape extending in an annular direction around a virtual central axis due to gas pressure; and radio wave reflective films each of which includes an outer peripheral edge portion attached to the annular balloon so as to be developed to a plane due to the expansion of the annular balloon, wherein the three annular balloons are provided so as to be orthogonal to each other in the expansion, the corner reflector further comprises a constraint fabric wound around each of the annular balloons in a winding direction orthogonal to the annular direction, the constraint fabric supports surface pressure from the annular balloon in an expansion state where the annular balloon annularly expand, to thereby restrict expansion of the annular balloon, the constraint fabric includes an inner peripheral side fabric portion which is located on a side of the virtual central axis of the annular balloon and which extends in the annular direction in the expansion state, and an outer peripheral side fabric portion which is located on a side opposite to the virtual central axis and which extends in the annular direction in the expansion state, and concerning an elongation degree representing an elongation characteristic of the constraint fabric, the elongation degree of the outer peripheral side fabric portion in the annular direction is higher than the elongation degree of the inner peripheral side fabric portion in the annular direction.

The corner reflector of the present invention may be configured as follows.

The constraint fabric is formed by warp fiber threads and weft fiber threads which are woven with each other, and in the expansion state, the warp fiber threads each extend in the annular direction and the weft fiber thread each extend in a direction crossing the annular direction, and concerning an elongation degree representing an elongation characteristic of each of the warp fiber threads, the elongation degree of each of the warp fiber thread forming the outer peripheral side fabric portion is higher than the elongation degree of each of the warp fiber thread forming the inner peripheral side fabric portion.

Thus, a fiber thread having a relatively high elongation degree is used as the warp fiber thread forming the outer peripheral side fabric portion, and a fiber thread having a relatively low elongation degree is used as the warp fiber thread forming the inner peripheral side fabric portion. Thereby, it is possible to form the constraint fabric having a high elongation degree in the outer peripheral side fabric portion and a low elongation degree in the inner peripheral side fabric portion.

As another option, the constraint fabric is formed by warp fiber threads and weft fiber threads which are woven with each other, and in the expansion state, the warp fiber threads each extend in the annular direction and the weft fiber thread each extend in a direction crossing the annular direction, and a weaving density of the warp fiber threads forming the outer peripheral side fabric portion is lower than a weaving density of the warp fiber threads forming the inner peripheral side fabric portion.

Thus, the weaving density of the warp fiber threads forming the outer peripheral side fabric portion is lower than the weaving density of the warp fibers thread forming the inner peripheral side fabric portion. Thereby, it is possible to form the constraint fabric having a high elongation degree in the outer peripheral side fabric portion and a low elongation degree in the inner peripheral side fabric portion.

The weft fiber threads include a first fiber thread and a second fiber thread, concerning an elongation degree representing an elongation characteristic of each of the weft fiber threads, the elongation degree of the second fiber thread is lower than the elongation degree of the first fiber thread, strength of the second fiber thread is higher than strength of the first fiber thread, and in the expansion state, the second fiber threads are arranged in the annular direction such that a density of the second fiber threads is less than a density of the first fiber threads.

Thus, provided as the weft fiber threads are the first fiber threads which are densely arranged in the annular direction and have relatively low strength and relatively high elongation degree, and the second fiber threads which are sparsely arranged in the annular direction and have relatively high strength and relatively low elongation degree are provided.

Accordingly, the force with which the first fiber threads restrict the expansion of the annular balloon can be reinforced by the second fiber threads with higher strength and a lower elongation degree. Although the second fiber thread is expensive, the cost can be suppressed, and the force of restricting the expansion of the annular balloon can be reinforced by arranging the second fiber threads such that a density of the second fiber threads is less than a density of the first fiber threads.

In order to achieve the above-described object, according to the present invention, there is provided a method for fabricating a corner reflector reflecting a radio wave comprising the steps of:

(A) preparing a balloon which has expanded in a cylindrical shape by supply of gas to an inside thereof, and a constraint fabric, (B) winding the constraint fabric wound around the cylindrical balloon, (C) joining axial direction end portions of the cylindrical balloon around which the constraint fabric is wound, to each other to transform the balloon into an annular balloon extending in an annular direction around a virtual central axis; and (D) joining end portions of the constraint fabric in the annular direction of the annular balloon, fabricating the annular balloons of which number is three, by the steps (A), (B), (C), and (D), the method comprising the steps of:

(E) assembling the three annular balloons to each other so that planes including annular shapes of the three annular balloons are orthogonal to each other, (F) attaching a radio wave reflective film to an inner side of each of the annular balloons to form a corner reflector, and (G) removing the gas from the inside of the annular balloons to deflate the annular balloons, wherein the constraint fabric supports surface pressure from the annular balloon in an expansion state where the annular balloon extends in the annular direction around the virtual central axis and annularly expand, to thereby restrict expansion of the annular balloon, the constraint fabric includes an inner peripheral side fabric portion which is located on a side of the virtual central axis of the annular balloon and which extends in the annular direction in the expansion state, and an outer peripheral side fabric portion which is located on a side opposite to the virtual central axis and which extends in the annular direction in the expansion state, and concerning an elongation degree representing an elongation characteristic of the constraint fabric, the elongation degree of the outer peripheral side fabric portion in the annular direction is higher than the elongation degree of the inner peripheral side fabric portion in the annular direction.

Advantageous Effects of Invention

According to the present invention described above, since the elongation degree of the outer peripheral side fabric portion is higher than the elongation degree of the inner peripheral side fabric portion in the constraint fabric, an annular balloon with high shape accuracy is obtained. The details are as follows.

When the annular balloon expands, a difference occurs between the annular direction length on the inner peripheral side of the annular balloon and the annular direction length on the outer peripheral side of the annular balloon.

With regard to this, according to the present invention, the elongation degree of the outer peripheral side fabric portion is higher than the elongation degree of the inner peripheral side fabric portion in the constraint fabric, and therefore the outer peripheral side fabric portion easily elongates but the inner peripheral side fabric portion has difficulty in elongating. More specifically, the inner peripheral side fabric portion is more resistant to elongate in the annular direction than the outer peripheral side fabric portion before expansion of the annular balloons. Thus, in the expansion state of the annular balloon, a variation in the elongated amount of the annular direction is suppressed or eliminated in the inner peripheral side fabric portion.

Accordingly, the constraint fabric can be prevented from being deformed in a direction different from the annular direction, at a part in the annular direction, or such deformation can be eliminated.

Therefore, even when the tuck processing is not performed on the inner peripheral side fabric portion of the constraint fabric, an annular balloon with high shape accuracy is obtained.

BRIEF DESCRIPTION OF DRAWINGS

FIG. 1A illustrates a corner reflector of Patent Document 1.

FIG. 1B illustrates reflection of radio waves by the corner reflector of FIG. 1A.

FIG. 2 is a cross-sectional view of an annular balloon.

FIG. 3A is an illustration of a method for fabricating an annular balloon.

FIG. 3B is another illustration of the method for fabricating an annular balloon.

FIG. 3C is another illustration of the method for fabricating an annular balloon.

FIG. 4A illustrates a corner reflector according to an embodiment of the present invention.

FIG. 4B is a cross-sectional view of an annular balloon and a constraint fabric in FIG. 4A.

FIG. 5A illustrates a configuration of the constraint fabric.

FIG. 5B is a partial enlarged view of FIG. 5A.

FIG. 6 is a flowchart of a method for fabricating a corner reflector according to the embodiment of the present invention.

FIG. 7A is an illustration of a method for fabricating a corner reflector according to the embodiment of the present invention.

FIG. 7B is another illustration of the method for fabricating a corner reflector according to the embodiment of the present invention.

FIG. 7C is another explanatory view illustrating the method for fabricating a corner reflector according to the embodiment of the present invention.

DESCRIPTION OF EMBODIMENTS

A preferable embodiment of the present invention is described with respect to the drawings. Portions common in respective drawings are designated by the same reference numerals and a duplicated description thereof is omitted.

FIG. 4A is a perspective view of a corner reflector 10 according to an embodiment of the present invention. As illustrated in FIG. 4A, the corner reflector 10 includes annular balloons 3*a*, 3*b*, and 3*c*, radio wave reflective films 5, and constraint fabrics 7 wound around the outer peripheral surfaces of the annular balloons 3*a*, 3*b*, and 3*c*.

The annular balloons 3*a*, 3*b*, and 3*c* have flexibility and airtightness, and, when gas is supplied to the inside thereof, each expand in an annular shapes extending in the annular direction around a virtual central axis due to the gas pressure as illustrated in FIG. 4A. The three annular balloons 3*a*, 3*b*, and 3*c* are assembled at the time of the expansion so that virtual planes including the annular shapes of the annular balloons 3*a*, 3*b*, and 3*c* are orthogonal to each other. Preferably, the three annular balloons 3*a*, 3*b*, and 3*c* are assembled so that chords equally dividing the annular shapes of the annular balloons 3*a*, 3*b*, and 3*c* respectively are orthogonal to each other. The annular balloons 3*a*, 3*b*, and 3*c* may be formed with plastic films such as polyolefin and polyvinyl chloride.

Outer peripheral edge portions 5*a* of the radio wave reflective films 5 are attached to the annular balloons 3*a*, 3*b*, and 3*c* so that the radio wave reflective films 5 are developed to the plane by the expansion of the annular balloons 3*a*, 3*b*, and 3*c*. Each of the radio wave reflective films 5 attached to each of the annular balloons 3*a*, 3*b*, and 3*c* is developed on a virtual plane containing the annular shape of the corresponding annular balloon by the expansion of each of the annular balloons 3*a*, 3*b*, and 3*c*. In the present embodiment, when three outer surfaces of the radio wave reflective films 5 orthogonal to each other as illustrated in FIG. 4A are assumed to be one set, eight sets of outer surfaces are formed by the expansion of the annular balloons 3*a*, 3*b*, and 3*c*. The description "the outer peripheral edge portions 5*a* of the radio wave reflective films 5 are attached to the annular balloons 3*a*, 3*b*, and 3*c*" may mean that the outer peripheral edge portions 5*a* are attached thereto via the constraint fabric 7 as described later or may mean that the outer peripheral edge portions 5*a* are attached to the annular balloons 3*a*, 3*b*, and 3*c* by other means.

The outer surface of the radio wave reflective film 5 is formed of a conductive material reflecting radio waves. As a preferable example, the radio wave reflective film 5 is fabric formed of conductive fibers. Here, the conductive fibers may be nylon fibers coated with a metal film (copper, silver, or the like), for example.

FIG. 4B is a cross-sectional view of the annular balloon 3*a*, 3*b*, or 3*c* and the constraint fabric 7, taken along the plane orthogonal to the annular direction of one annular balloon 3*a*, 3*b*, or 3*c*. Each of the annular balloons 3*a*, 3*b*, and 3*c* and the constraint fabric 7 thereof have the cross-sectional structure, at each position in the annular direction, illustrated in FIG. 4B.

The constraint fabric 7 is formed of fibers (for example, nylon, polyester, and the like) through which radio waves penetrate.

The constraint fabrics 7 are attached to the annular balloons 3*a*, 3*b*, and 3*c* and restrict the expansion amount of the annular balloons 3*a*, 3*b*, and 3*c*. More specifically, the constraint fabrics 7 each extend in a winding direction (FIG. 4B) orthogonal to the annular direction to be wound around each of the annular balloons 3*a*, 3*b*, and 3*c*. The constraint fabrics 7 support surface pressure (pressure of the gas inside the annular balloon) from the annular balloons 3*a*, 3*b*, and 3*c* in the state (hereinafter also simply referred to as expansion state) where the annular balloons 3*a*, 3*b*, and 3*c* annularly expand, to thereby restrict the expansion of the annular balloons 3*a*, 3*b*, and 3*c*. In an example, the constraint fabrics 7 are wound around the annular balloons 3*a*, 3*b*, and 3*c* in the winding direction so as to contact the annular balloons 3*a*, 3*b*, and 3*c*.

In this application, the annular direction means a direction in which the annular balloons 3*a*, 3*b*, and 3*c* annularly extend around a virtual central axis C in the state where the annular balloons 3*a*, 3*b*, and 3*c* expand.

In the expansion state of the annular balloons, the constraint fabrics 7 each extend in the annular direction over the entire annular direction of the corresponding annular balloon 3*a*, 3*b*, or 3*c*.

The constraint fabrics 7 each include an inner peripheral side fabric portion 7*a* surrounded by a dashed line X of FIG. 4B and an outer peripheral side fabric portion 7*b* surrounded by a dashed line Y of FIG. 4B. The inner peripheral side fabric portion 7*a* is located on the side of the virtual central axis C described above, and extends in the annular direction in the expansion state. The outer peripheral side fabric portion 7*b* is located on a side opposite to the virtual central axis C, and extends in the annular direction in the expansion state. The elongation degree of the outer peripheral side fabric portion 7*b* in the annular direction is higher than the elongation degree of the inner peripheral side fabric portion 7*a* in the annular direction. Here, the elongation degree represents the elongation characteristic of the constraint fabric 7, and is defined as follows. More specifically, the elongation degree of the constraint fabric 7 is defined as the numerical value representing an elongated amount of a fixed unit length of the constraint fabric 7 when the constraint fabric 7 is elongated by this elongated amount due to fixed tensile force acting on the constraint fabric 7 from the state where no external force acts on the constraint fabric 7. When the elongation degree is higher, the elongated amount of the constraint fabric 7 due to the fixed tensile force also becomes larger. Therefore, an elongated amount of the unit length of the outer peripheral side fabric portion 7*b* in the annular direction due to tensile force acting on the outer peripheral side fabric portion 7*b* in the annular direction from the state where no external force acts on the outer peripheral side fabric portion 7*b* is larger than an elongated amount of the same unit length of the inner peripheral side fabric portion 7*a* in the annular direction due to the same tensile force acting on the inner peripheral side fabric portion 7*a* in the annular direction from the state where no external force acts on the inner peripheral side fabric portion 7*a*.

In the present embodiment, the constraint fabrics 7 each include an intermediate fabric portion 7*c* (surrounded by a dashed line Z of FIG. 4B) located between the inner peripheral side fabric portion 7*a* and the outer peripheral side fabric portion 7*b*. In an example, an elongation degree of the intermediate fabric portion 7*c* in the annular direction is the same as that of the outer peripheral side fabric portion 7*b* in the annular direction. However, the present invention is not limited thereto. For example, the elongation degree of the intermediate fabric portion 7*c* in the annular direction may be lower than the elongation degree of the outer peripheral side fabric portion 7*b* in the annular direction and may be higher than the elongation degree of the inner peripheral side fabric portion 7*a* in the annular direction.

FIG. 5A illustrates the constraint fabric 7 in the state (developed state) where the constraint fabric 7 is not wound around the annular balloons 3*a*, 3*b*, and 3*c*. In FIG. 5A, the constraint fabric 7 has a long and narrow rectangular shape in the developed state. In the state of FIG. 5A, no force acts on the constraint fabric 7 from the outside, and thus the constraint fabric 7 does not elongate in any direction. In FIG. 5A, the long side direction of the constraint fabric 7 corresponds to the annular direction of the corresponding annular balloon 3*a*, 3*b*, or 3*c*. More specifically, due to the expansion of the annular balloon 3*a*, 3*b*, or 3*c*, the constraint fabric 7 attached to the annular balloon 3*a*, 3*b*, or 3*c* is also transformed into an annular shape according to the annular shape of the annular balloon 3*a*, 3*b*, or 3*c*, and the long side direction of the constraint fabric 7 becomes the annular direction of the annular balloon 3*a*, 3*b*, or 3*c*. In FIG. 5A, X represents the range of the inner peripheral side fabric portion 7*a*, Y represents the range of the outer peripheral side fabric portion 7*b*, and Z represents the range of the intermediate fabric portion 7*c*. The same applies to FIG. 5B.

In FIG. 5A, the short side direction of the constraint fabric 7 is orthogonal to the long side direction described above. The constraint fabric 7 is wound around the annular balloons 3*a*, 3*b*, or 3*c*, and both short side direction end portions 7*d* in the constraint fabric 7 are joined to each other by sewing with a sewing thread 9, for example, as illustrated in FIG. 4B.

As illustrated in FIG. 4B, the outer peripheral edge portion 5*a* of the radio wave reflective film 5 is sewn to both the short side direction end portions 7*d* in the constraint fabric 7 with a joining thread 6. Thus, the radio wave reflective film 5 is attached to the annular balloon 3*a*, 3*b*, or 3*c* via both the short side direction end portions 7*d* in the constraint fabric 7.

FIG. 5B is a partial enlarged view of FIG. 5A. The constraint fabric 7 is formed of warp fiber threads 11 and weft fiber threads 13 which are woven with each other. In other words, the constraint fabric 7 is formed by entangling a large number of the warp fiber threads 11 and a large number of the weft fiber threads 13 with each other as illustrated in FIG. 5B. More specifically, the constraint fabric 7 is composed of a large number of the warp fiber threads 11 and a large number of the weft fiber threads 13 that are woven such that a large number of the warp fiber threads 11 and a large number of the weft fiber threads 13 entangle each other. In the expansion state, a large number of the warp fiber threads 11 extend in the annular direction over the entire annular direction of the annular balloon and a large number of the weft fiber threads 13 extend in a direction crossing (preferably orthogonal to) the annular direction from one end to the other end in this direction in the constraint fabric 7. In the state of FIG. 5B, a large number of the warp fiber threads 11 extend in the long side direction from one end in the long side direction to the other end in the long side direction of the constraint fabric 7, and a large number of the weft fiber threads 13 extend in the short side direction from one end in the short side direction to the other end in the short side direction of the constraint fabric 7. In FIG. 5B, a large number of the warp fiber threads 11 are arranged in the short side direction and a large number of the weft fiber threads 13 are arranged in the long side direction. When the annular balloons 3*a*, 3*b*, and 3*c* expand to have an annular shape, a large number of the warp fiber threads 11 extend in the annular direction and a large number of the weft fiber threads 13 extend in the direction crossing the annular direction.

Although FIG. 5B illustrates the constraint fabric 7 woven by plain weave, the constraint fabric 7 may be woven by other weaving methods (for example, twill weave, satin weave, double weave, and the like). More specifically, the constraint fabric 7 may be woven by any arbitrary weaving method insofar as the constraint fabric 7 is formed by entangling a large number of the warp fiber threads 11 and a large number of the weft fiber threads 13 with each other.

According to the present embodiment, an elongation degree of each warp fiber thread 11 (hereinafter referred to as warp fiber thread 11*b*) forming the outer peripheral side fabric portion 7*b* is higher than an elongation degree of each warp fiber thread 11 (hereinafter referred to as warp fiber thread 11*a*) forming the inner peripheral side fabric portion 7*a*. Here, the elongation degree represents the elongation characteristic of one warp fiber thread (for example, each warp fiber thread 11*a* or 11*b*) as a constituent element of the constraint fabric 7, and is defined as follows. More specifically, the elongation degree of the warp fiber thread 11 is defined as the numerical value representing an elongated amount of a fixed unit length of one warp fiber thread 11 when certain tensile force acts on the warp fiber thread 11 from the state where no external force acts on the warp fiber thread 11. As the elongation degree of the warp fiber thread 11 is higher, the elongated amount of the warp fiber thread 11 due to fixed tensile force also becomes larger.

Therefore, the annular-direction elongated amount of the unit length of each warp fiber thread 11*b* due to tensile force acting on each warp fiber thread 11*b* in the annular direction from the state where no external force acts on each warp fiber thread 11*b* forming the outer peripheral side fabric portion 7*b* is larger than the annular-direction elongated amount of the same unit length of each warp fiber thread 11*a* due to the same tensile force acting on each warp fiber thread 11*a* in the annular direction from the state where no external force acts on each warp fiber thread 11*a* forming the inner peripheral side fabric portion 7*a*.

In an example, first fiber threads 13*a* and second fiber threads 13*b* are provided as the weft fiber threads 13. The first fiber threads 13*a* are densely arranged in the long side direction (annular direction in the expansion state). The second fiber threads 13*b* are sparsely arranged in the long side direction (annular direction in the expansion state). More specifically, the second fiber threads 13*b* are arranged more sparsely than the first fiber threads 13*a*, in the long side direction (annular direction in the expansion state). In FIG. 5B, assuming two adjacent second fiber threads 13*b* to be one set, five first fiber threads 13*a* are disposed between the two second fiber threads 13*b* of each set. However, two or more of the first fiber threads 13*a* other than the five first fiber threads 13*a* may be disposed between the two second fiber threads 13*b* of each set.

An elongation degree of the second fiber thread 13*b* is lower than an elongation degree of the first fiber thread 13*a*. Here, the elongation degree represents the elongation characteristic of one weft fiber thread 13 (first fiber thread 13*a* or second fiber thread 13*b*) as a constituent element of the constraint fabric 7, and is defined as follows. The elongation degree of the weft fiber thread 13 is defined as the numerical value representing an elongated amount of a fixed unit length of one weft fiber thread 13 when certain tensile force acts on the weft fiber thread 13 from the state where no external force acts on the weft fiber thread 13. As the elongation degree of the weft fiber thread 13 is higher, the elongated amount of the weft fiber thread 13 due to the fixed tensile force becomes also larger.

Therefore, the elongated amount of a unit length of the second fiber thread 13*b* due to tensile force acting on the second fiber thread 13*b* from the state where no external force acts on the second fiber thread 13*b* is smaller than the elongated amount of the same unit length of the first fiber thread 13*a* due to the same tensile force acting on the first fiber thread 13*a* from the state where no external force acts on the first fiber thread 13*a*.

The strength of the second fiber thread 13*b* is higher than the strength (i.e., tensile strength) of the first fiber thread 13*a*.

Specific examples of materials of each fiber thread forming the constraint fabric 7 are described. In an example, each warp fiber thread 11*b* forming the outer peripheral side fabric portion 7*b* and each warp fiber thread 11 (hereinafter referred to as warp fiber thread 11*c*) forming the intermediate fabric portion 7*c* are formed of nylon, each warp fiber thread 11*a* forming the inner peripheral side fabric portion 7*a* is formed of polyester, the first fiber thread 13*a* is formed of nylon, and the second fiber thread 13*b* is formed of liquid crystalline polyester or aramid fibers (for example, Kevlar (®)).

Assuming that the elongation degree of each warp fiber thread 11*a* forming the inner peripheral side fabric portion 7*a* is A, and the elongation degree of each warp fiber thread 11*b* forming the outer peripheral side fabric portion 7*b* is B, the ratio of A to B is 5% to 30% in an example, 5% to 20% in another example, and 5% to 15% in a still another example.

However, according to the present invention, the ratio of A to B is not limited to these examples, as described below. According to the present invention, since the inner peripheral side fabric portion 7*a* exhibits less elongation in the annular direction than the outer peripheral side fabric portion 7*b* before and after expansion of the annular balloons 3*a*, 3*b*, and 3*c*, a variation in the elongated amount in the annular direction is suppressed or eliminated in the inner peripheral side fabric portion 7*a* in the expansion state of the annular balloons 3*a*, 3*b*, and 3*c*. The ratio of A to B may be set so as to obtain such an operational effect.

It is desirable that the weft fiber thread 13 has a low elongation degree and high strength. This is because the weft fiber threads 13 constrain the annular balloons 3*a*, 3*b*, and 3*c* in the expansion state. Therefore, the weft fiber thread 13 is preferably formed of liquid crystalline polyester or aramid fibers, for example. However, when all the weft fiber threads 13 are formed of liquid crystalline polyester fibers or aramid fibers, the constraint fabric 7 becomes hard, heavy, and expensive. In consideration of this matter, it is preferable to densely dispose the first fiber threads 13*a* formed of nylon which is inexpensive and lightweight but has high elongation degree and low strength and sparsely dispose the second fiber threads 13*b* formed of liquid crystalline polyester or aramid fibers. Thus, the annular balloons 3*a*, 3*b*, and 3*c* in the expansion state can be constrained with the inexpensive and lightweight constraint fabric 7. However, the present invention is not limited to such a configuration and all the weft fiber threads 13 may be formed of the liquid crystalline polyester fibers or aramid fibers or may be formed of other materials.

Next, a method for fabricating the corner reflector 10 according to an embodiment of the present invention is described. FIG. 6 is a flowchart of the fabricating method and FIG. 7A to FIG. 7C are illustrations of the fabricating method.

At the step S1, as illustrated in FIG. 7A, a balloon 4 which has expanded in a cylindrical shape by supply of gas to the inside thereof, and the constraint fabric 7 are prepared. Short side direction end portions 7*d* and long side direction end portions 7*e* of the constraint fabric 7 are prevented from fraying by appropriate means.

At the step S1, gas is supplied to the inside of the balloon 4 from a gas supply hole provided in the balloon 4 to expand the balloon 4, and then the gas supply hole is closed with appropriate means so that the expansion state of the balloon 4 is maintained.

At the step S2, the constraint fabric 7 is wound around the cylindrical balloon 4 as illustrated in FIG. 7B. Specifically, the constraint fabric 7 is wound around the cylindrical balloon 4, and in this state, the short side direction end portions 7*d* in the constraint fabric 7 are then joined to each other by sewing with the sewing thread 9, for example (refer to FIG. 4B).

At the step S3, the cylindrical balloon 4 is bent to be formed into an annular shape as illustrated in FIG. 7C. More specifically, the axial direction end portions of the cylindrical balloon 4 around which the constraint fabric 7 is wound are joined to transform the cylindrical balloon 4 into the annular balloons 3*a*, 3*b*, or 3*c*. Here, the joining of the axial direction end portions 4*a* of the balloon 4 may be performed with a pressure sensitive adhesive tape, an adhesive, or other means.

At the step S4, the end portions 7*e* in the longitudinal direction (annular direction in the state of FIG. 7C) in the constraint fabric 7 are joined by sewing, for example, over the entire winding direction (refer to FIG. 4B). In this state, the elongated amount in the annular direction of the warp fiber thread 11*b* of the outer peripheral side fabric portion 7*b* in the constraint fabric 7 is larger than the elongated amount in the annular direction of the warp fiber thread 11*a* of the inner peripheral side fabric portion 7*a* in the constraint fabric 7. More specifically, in the constraint fabric 7, the annular direction length of the warp fiber thread 11*b* of the outer peripheral side fabric portion 7*b* is longer than the annular direction length of the warp fiber thread 11*a* of the inner peripheral side fabric portion 7*a*.

By the steps S1 to S4 described above, one annular balloon 3*a*, 3*b*, or 3*c* around which the constraint fabric 7 is wound is fabricated. Other two annular balloons around which the constraint fabric 7 is wound are also fabricated by the steps S1 to S4 described above. Thus, each of the three annular balloons 3*a*, 3*b*, and 3*c* around which the constraint fabric 7 is wound is fabricated by the steps S1 to S4.

At the step S5, the three annular balloons 3*a*, 3*b*, and 3*c* around which the constraint fabric 7 is wound are assembled to each other as illustrated in FIG. 4A. At this time, the planes including the annular shapes of the three annular balloons 3*a*, 3*b*, and 3*c* are set to be orthogonal to each other. In an example, when the axial direction end portions in each of the three cylindrical balloons 4 are joined to each other at the step S3 described above, this joining can be made such that the other annular balloons penetrate through the inner side of the annular shape of each of the three annular balloons 3*a*, 3*b*, and 3*c* fabricated by this joining (as in the state of FIG. 4A).

However, according to the present invention, it is sufficient that the three annular balloons 3*a*, 3*b*, and 3*c* are assembled to each other in the state where the planes including the annular shapes of the three annular balloons 3*a*, 3*b*, and 3*c* are orthogonal to each other. In order to maintain the state where the three annular balloons 3*a*, 3*b*, and 3*c* are assembled to each other as described above, at each portion (each portion surrounded by a dashed line N of FIG. 4A) where the two annular balloons are adjacent to each other and cross each other, the two annular balloons are joined by tying the same with a string or bonding the same with Velcro (®).

At the step S6, the radio wave reflective film 5 is attached to the inner side of each of the annular balloon 3*a*, 3*b*, and 3*c* as illustrated in FIG. 4A. Here, as illustrated in FIG. 4A, assuming that the three outer surfaces orthogonal to each other in the radio wave reflective films 5 constitute one set, eight sets of the outer surfaces are formed.

For example, the step S6 may be performed as follows. The twelve radio wave reflective films 5 of a fan shape having the central angle of 90° are prepared.

As illustrated in FIG. 4B, with the joining thread 6, an arc-shaped portion (i.e., outer peripheral edge portion 5*a*) of each of the radio wave reflective films 5 is sewn, over the entire arc-shaped portion, to the short side direction end portions 7*d* of the constraint fabric 7 wound around the annular balloon so that the arc-shaped portion (outer peripheral edge portion 5*a*) of each of the radio wave reflective films 5 is joined to the corresponding annular balloon.

As illustrated in FIG. 4A, the linear-shaped outer edge portions 5*b* of the respective radio wave reflective films 5 are sewn to each other with a sewing thread (not illustrated) for joining.

At the step S7, gas is removed from the inside of the annular balloons 3*a*, 3*b*, and 3*c* to deflate the annular balloons 3*a*, 3*b*, and 3*c*. In addition, a gas supply device (not illustrated) supplying gas into the annular balloons 3*a* and 3*b* and 3*c* is attached to the corner reflector 10.

The corner reflector 10 is launched from a vessel (ship), the ground, or the like, for example, into the air in the state where the annular balloons are deflated, and then gas is supplied into the annular balloons 3*a* and 3*b* and 3*c* by the gas supply device attached to the corner reflector 10 so that the corner reflector is developed as illustrated in FIG. 4A. More specifically, the three annular balloons 3*a*, 3*b*, and 3*c* are assembled to each other in the annular expansion state at the step S5 described above and deflated at the step S7 while maintaining the assembly. Therefore, when gas is supplied to the inside of the annular balloons 3*a*, 3*b*, and 3*c*, the annular balloons 3*a*, 3*b*, and 3*c* annularly expand from the deflated state due to the gas pressure. The gas supply device may be a gas cylinder, a gas generator using gunpowder, or the like, for example, and is activated so as to supply gas into the annular balloons 3*a*, 3*b*, and 3*c* at desired timing.

Due to the development of the corner reflector 10 in the air, for example, a missile radar seeker sets the corner reflector 10 as a tracking target by a reflected radio wave from the corner reflector 10. Thus, the corner reflector 10 can be used as a decoy for a missile.

According to the embodiment of the present invention described above, the annular balloons 3*a*, 3*b*, and 3*c* with high shape accuracy are obtained since the elongation degree of the outer peripheral side fabric portion 7*b* is higher than the elongation degree of the inner peripheral side fabric portion 7*a* in the constraint fabric 7. The details are as follows.

When the annular balloons 3*a*, 3*b*, and 3*c* expand, a difference occurs between the annular direction length on the inner peripheral side of the annular balloons 3*a*, 3*b*, and 3*c* and the annular direction length on the outer peripheral side of the annular balloons.

With regard to this, according to the present embodiment, the elongation degree of the outer peripheral side fabric portion 7*b* is higher than the elongation degree of the inner peripheral side fabric portion 7*a* in the constraint fabric 7, and therefore the outer peripheral side fabric portion 7*b* easily elongates, but the inner peripheral side fabric portion 7*a* has difficulty in elongating. More specifically, the inner peripheral side fabric portion 7*a* is more resistant to elongate in the annular direction than the outer peripheral side fabric portion 7*b* before expansion of the annular balloons 3*a*, 3*b*, and 3*c*. Thus, the constraint fabric 7 can be prevented from being deformed in a direction different from the annular direction or such deformation can be eliminated.

Therefore, even when tuck processing is not performed to the inner peripheral side portion 7*a* of the constraint fabric 7, the annular balloons 3*a*, 3*b*, and 3*c* with high shape accuracy can be obtained.

The present invention is not limited to the embodiment described above, and can be variously modified without deviating from the scope of the present invention. For example, according to the present invention, any one of the following modification examples 1 to 4 may be adopted or two or more of the modification examples 1 to 4 may be adopted in combination. In this case, the contents which are not described below are the same as the above-described contents.

Modification Example 1

According to the present invention, it is sufficient that the elongation degree of the outer peripheral side fabric portion 7*b* in the annular direction is higher than the elongation degree of the inner peripheral side fabric portion 7*a* in the annular direction in the constraint fabric 7.

According to Modification Example 1, in an example, the constraint fabric 7 may be formed by sewing a fabric composed of the outer peripheral side fabric portion 7*b* and the intermediate fabric portion 7*c* to the inner peripheral side fabric portion 7*a*.

Modification Example 2

The elongation degree of each warp fiber thread 11*c* forming the intermediate fabric portion 7*c* in the range Z in FIG. 5A may be higher than the elongation degree of each warp fiber thread 11*a* forming the inner peripheral side fabric portion 7*a*, and may be lower than the elongation degree of each warp fiber thread 11*b* forming the outer peripheral side fabric portion 7*b*.

Modification Example 3

In the above description, the elongation degree of each warp fiber thread 11*b* forming the outer peripheral side fabric portion 7*b* is set to be higher than the elongation degree of each warp fiber thread 11*a* forming the inner peripheral side fabric portion 7*a* so that the elongation degree of the outer peripheral side fabric portion 7*b* in the annular direction is made higher than the elongation degree of the inner peripheral side fabric portion 7*a* in the annular direction (in this case, the weaving density of the warp fiber threads 11*b* and the weaving density of the warp fiber threads 11*a* may be the same.).

In contrast to this, according to Modification Example 3, the elongation degree of the outer peripheral side fabric portion 7*b* in the annular direction may be set to be higher than the elongation degree of the inner peripheral side fabric portion 7*a* in the annular direction by setting the weaving density of the warp fiber threads 11*b* forming the outer peripheral side fabric portion 7*b* to be lower than weaving density of the warp fiber threads 11*a* forming the inner peripheral side fabric portion 7*a* in the state of FIG. 5A and FIG. 5B. In this case, the elongation degree of the warp fiber thread 11*b* may be the same as the elongation degree of the warp fiber thread 11*a*, or may be different from the elongation degree of the warp fiber thread 11*a*.

Modification Example 4

In the expansion state, the elongation degree in the annular direction of the intermediate fabric portion 7*c* may gradually decrease as shifting toward the virtual central axis C side. Similarly, in the expansion state, the elongation degree in the annular direction of the outer peripheral side fabric portion 7*b* may gradually decreases as shifting toward the virtual central axis C side. Furthermore, in the expansion state, the elongation degree in the annular direction of the inner peripheral side fabric portion 7*a* may gradually decrease as shifting toward the virtual central axis C side. In such a case, the elongation degree in the annular direction of a portion on the side closest to the virtual central axis C in the intermediate fabric portion 7*c* may be equal to or higher than the elongation degree in the annular direction of a portion on the side farthest from the virtual central axis C in the inner peripheral side fabric portion 7*a*. The elongation degree in the annular direction of a portion on the side farthest from the virtual central axis C in the intermediate fabric portion 7*c* may be equal to or lower than the elongation degree in the annular direction of a portion on the side closest to the virtual central axis C in the outer peripheral side fabric portion 7*b*.

REFERENCE SIGNS LIST

3*a*, 3*b*, 3*c* Annular balloon, 4 Balloon, 4*a* Axial direction end portion of balloon, 5 Radio wave reflective film, 5*a* Outer peripheral edge portion, 5*b* Outer edge portion, 6 Joining thread, 7 Constraint fabric, 7*a* Inner peripheral side fabric portion, 7*b* Outer peripheral side fabric portion, 7*c* Intermediate fabric portion, 7*d* Short side direction end portion, 7*e* Long side direction end portion, 9 Sewing thread,

10 Corner reflector, 11, 11*a*, 11*b*, 11*c* Warp fiber thread, 13 Weft fiber thread, 13*a* First fiber thread, 13*b* Second fiber thread, C Virtual central axis

The invention claimed is:

1. A corner reflector reflecting a radio wave, the corner reflector comprising:

three annular balloons each of which has flexibility and airtightness, and, when gas is supplied to an inside thereof, expands to an expanded annular shape extending in an annular direction around a virtual central axis when gas is supplied to the inside of the respective annular balloon; and a plurality of radio wave reflective films each of which includes an outer peripheral edge portion attached to an annular balloon so as to define a plane when the respective annular balloon is expanded, wherein the three annular balloons expand to be orthogonal to one another in the expanded annular shape when gas is supplied to the inside of the annular balloons, the corner reflector further comprises a constraint fabric wound around each of the annular balloons in a winding direction orthogonal to the annular direction, wherein the constraint fabric constricts the annular balloon in the expanded annular shape, to thereby restrict expansion of the annular balloon, wherein the constraint fabric includes an inner peripheral side fabric portion and an outer peripheral side fabric portion that extend in the annular direction in the expanded annular shape, wherein the outer peripheral side fabric portion is located further from the virtual central axis of the annular balloon in the expanded annular shape, than the inner peripheral side fabric portion, and wherein an elongation degree of the outer peripheral side fabric portion in the annular direction is higher than the elongation degree of the inner peripheral side fabric portion in the annular direction, wherein the elongation degree is defined as a numerical value representing an elongated amount of a fixed unit length of the constraint fabric when the constraint fabric is elongated due to fixed tensile force acting on the constraint fabric from a state where no external force acts on the constraint fabric.

2. The corner reflector according to claim 1, wherein the constraint fabric is formed by warp fiber threads and weft fiber threads which are woven with each other, and in the expanded annular shape, the warp fiber threads each extend in the annular direction and the weft fiber thread each extend in a direction crossing the annular direction, and concerning an elongation degree representing an elongation characteristic of each of the warp fiber threads, the elongation degree of each of the warp fiber thread forming the outer peripheral side fabric portion is higher than the elongation degree of each of the warp fiber thread forming the inner peripheral side fabric portion.

3. The corner reflector according to claim 1, wherein the constraint fabric is formed by warp fiber threads and weft fiber threads which are woven with each other, and in the expanded annular shape, the warp fiber threads each extend in the annular direction and the weft fiber thread each extend in a direction crossing the annular direction, and a weaving density of the warp fiber threads forming the outer peripheral side fabric portion is lower than a weaving density of the warp fiber threads forming the inner peripheral side fabric portion.

4. The corner reflector according to claim 2, wherein the weft fiber threads include a first fiber thread and a second fiber thread, concerning an elongation degree representing an elongation characteristic of each of the weft fiber threads, the elongation degree of the second fiber thread is lower than the elongation degree of the first fiber thread, strength of the second fiber thread is higher than strength of the first fiber thread, and in the expanded annular shape in the annular direction, a volumetric density of the second fiber threads is less than a volumetric density of the first fiber threads.

5. The corner reflector according to claim 3, wherein the weft fiber threads include a first fiber thread and a second fiber thread, concerning an elongation degree representing an elongation characteristic of each of the weft fiber threads, the elongation degree of the second fiber thread is lower than the elongation degree of the first fiber thread, strength of the second fiber thread is higher than strength of the first fiber thread, and in the expanded annular shape in the annular direction such that a volumetric density of the second fiber threads is less than a volumetric density of the first fiber threads.

6. A method for fabricating a corner reflector reflecting a radio wave comprising the steps of:

(A) preparing a balloon which has an expanded annular shape by supply of gas to an inside thereof, and a constraint fabric, (B) winding the constraint fabric wound around the cylindrical balloon, (C) joining axial direction end portions of the cylindrical balloon around which the constraint fabric is wound, to each other to transform the balloon into an annular balloon extending in an annular direction around a virtual central axis; and (D) joining end portions of the constraint fabric in the annular direction of the annular balloon, fabricating the annular balloons of which number is three, by the steps (A), (B), (C), and (D), the method comprising the steps of:

(E) assembling the three annular balloons to each other so that planes including expanded annular shapes of the three annular balloons are orthogonal to each other, (F) attaching a radio wave reflective film to an inner side of each of the annular balloons to form a corner reflector, and (G) removing the gas from the inside of the annular balloons to deflate the annular balloons, wherein the constraint fabric constricts the annular balloon in the annular shape to thereby restrict expansion of the annular balloon, wherein the constraint fabric includes an inner peripheral side fabric portion and an outer peripheral side fabric portion that extend in the annular direction in the expanded annular shape, wherein the outer peripheral side fabric portion is located further from the virtual central axis of the annular balloon in the expanded annular shape, than the inner peripheral side fabric portion, and wherein an elongation degree of the outer peripheral side fabric portion in the annular direction is higher than the elongation degree of the inner peripheral side fabric portion in the annular direction, wherein the elongation degree is defined as a numerical value representing an elongated amount of a fixed unit length of the constraint fabric when the constraint fabric is elongated due to fixed tensile force acting on the constraint fabric from a state where no external force acts on the constraint fabric.

* * * * *